US008746261B2

(12) United States Patent
Welch

(10) Patent No.: US 8,746,261 B2
(45) **Date of Patent: *Jun. 10, 2014**

(54) ROTATING DRUM FILTER FOR A DISHWASHING MACHINE

(75) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1147 days.

This patent is subject to a terminal disclaimer.

(21) Appl. No.: 12/643,394

(22) Filed: Dec. 21, 2009

(65) Prior Publication Data

US 2011/0146730 A1 Jun. 23, 2011

(51) Int. Cl.
*A47L 15/42* (2006.01)

(52) U.S. Cl.
USPC ..... 134/104.4

(58) Field of Classification Search
USPC ..... 134/104.4
See application file for complete search history.

(56) References Cited

U.S. PATENT DOCUMENTS

| | | | |
|---|---|---|---|
| 1,617,021 | A | 2/1927 | Mitchell |
| 2,154,559 | A | 4/1939 | Bilde |
| 2,422,022 | A | 6/1947 | Koertge |
| 2,734,122 | A | 2/1956 | Flannery |
| 3,026,628 | A | 3/1962 | Berger, Sr. et al. |
| 3,068,877 | A | 12/1962 | Jacobs |
| 3,103,227 | A | 9/1963 | Long |
| 3,122,148 | A | 2/1964 | Alabaster |
| 3,186,417 | A | 6/1965 | Fay |
| 3,288,154 | A | 11/1966 | Jacobs |
| 3,542,594 | A | 11/1970 | Smith et al. |
| 3,575,185 | A | 4/1971 | Barbulesco |
| 3,586,011 | A | 6/1971 | Mazza |
| 3,801,280 | A | 4/1974 | Shah et al. |
| 3,846,321 | A | 11/1974 | Strange |
| 3,989,054 | A | 11/1976 | Mercer |
| 4,179,307 | A | 12/1979 | Cau et al. |
| 4,180,095 | A | 12/1979 | Woolley et al. |
| 4,326,552 | A | 4/1982 | Bleckmann |
| 4,754,770 | A | 7/1988 | Fornasari |
| 5,002,890 | A | 3/1991 | Morrison |
| 5,331,986 | A | 7/1994 | Lim et al. |
| 5,454,298 | A | 10/1995 | Lu |

(Continued)

FOREIGN PATENT DOCUMENTS

| | | |
|---|---|---|
| CH | 169630 | 6/1934 |
| CN | 2571812 Y | 9/2003 |

(Continued)

OTHER PUBLICATIONS

German Search Report for DE102011053666, Oct. 21, 2011.

(Continued)

*Primary Examiner* — Michael Barr
*Assistant Examiner* — Jason Riggleman

(57) ABSTRACT

A dishwashing machine includes a housing in fluid communication with a washing chamber and a filter positioned in the housing that is operable to rotate about a longitudinal axis. A flow diverter is positioned within the inner chamber at a location between the housing and the rotary filter and is spaced apart from the rotary filter so as to create a gap. During rotation of the filter, the angular velocity of fluid advanced through the gap is increased relative to the angular velocity of the fluid prior to entering the gap.

22 Claims, 5 Drawing Sheets

(56) References Cited

U.S. PATENT DOCUMENTS

| | | | | |
|---|---|---|---|---|
| 5,470,142 | A | 11/1995 | Sargeant et al. | |
| 5,569,383 | A | 10/1996 | Vander Ark, Jr. et al. | |
| 5,711,325 | A | 1/1998 | Kloss et al. | |
| 5,755,244 | A | 5/1998 | Sargeant et al. | |
| 5,868,937 | A | 2/1999 | Back et al. | |
| 5,904,163 | A | 5/1999 | Inoue et al. | |
| 5,924,432 | A | 7/1999 | Thies et al. | |
| 6,289,908 | B1 | 9/2001 | Kelsey | |
| 6,389,908 | B1 | 5/2002 | Chevalier et al. | |
| 6,460,555 | B1 | 10/2002 | Tuller et al. | |
| 6,491,049 | B1 | 12/2002 | Tuller et al. | |
| 6,601,593 | B2 | 8/2003 | Deiss et al. | |
| 6,997,195 | B2 | 2/2006 | Durazzani et al. | |
| 7,047,986 | B2 | 5/2006 | Ertle et al. | |
| 7,069,181 | B2 | 6/2006 | Jerg et al. | |
| 7,093,604 | B2 | 8/2006 | Jung et al. | |
| 7,198,054 | B2 | 4/2007 | Welch | |
| 7,232,494 | B2 | 6/2007 | Rappette | |
| 7,270,132 | B2 | 9/2007 | Inui et al. | |
| 7,347,212 | B2 | 3/2008 | Rosenbauer | |
| 7,350,527 | B2 | 4/2008 | Gurubatham et al. | |
| 7,363,093 | B2 | 4/2008 | King et al. | |
| 7,406,843 | B2 | 8/2008 | Thies et al. | |
| 7,445,013 | B2 | 11/2008 | VanderRoest et al. | |
| 7,497,222 | B2 | 3/2009 | Edwards et al. | |
| 7,523,758 | B2 | 4/2009 | Vanderroest et al. | |
| 7,594,513 | B2 | 9/2009 | VanderRoest et al. | |
| 7,819,983 | B2 | 10/2010 | Kim et al. | |
| 7,896,977 | B2 | 3/2011 | Gillum et al. | |
| 8,161,986 | B2 | 4/2012 | Allessandrelli | |
| 2003/0037809 | A1 | 2/2003 | Favaro | |
| 2004/0007253 | A1 | 1/2004 | Jung et al. | |
| 2004/0103926 | A1 | 6/2004 | Ha | |
| 2005/0022849 | A1 | 2/2005 | Park et al. | |
| 2006/0123563 | A1 | 6/2006 | Raney et al. | |
| 2006/0162744 | A1 | 7/2006 | Walkden | |
| 2006/0174915 | A1 | 8/2006 | Hedstrom et al. | |
| 2007/0006898 | A1 | 1/2007 | Lee | |
| 2007/0107753 | A1 | 5/2007 | Jerg | |
| 2007/0163626 | A1 | 7/2007 | Klein | |
| 2007/0266587 | A1 | 11/2007 | Bringewatt et al. | |
| 2008/0116135 | A1* | 5/2008 | Rieger et al. | 210/650 |
| 2008/0289664 | A1 | 11/2008 | Rockwell et al. | |
| 2009/0095330 | A1 | 4/2009 | Iwanaga et al. | |
| 2009/0283111 | A1 | 11/2009 | Classen et al. | |
| 2010/0012159 | A1 | 1/2010 | Verma et al. | |
| 2010/0043826 | A1 | 2/2010 | Bertsch et al. | |
| 2010/0043847 | A1 | 2/2010 | Yoon et al. | |
| 2010/0154830 | A1 | 6/2010 | Lau et al. | |
| 2010/0154841 | A1 | 6/2010 | Fountain et al. | |
| 2010/0224223 | A1 | 9/2010 | Kehl et al. | |
| 2010/0252081 | A1 | 10/2010 | Classen et al. | |
| 2011/0061682 | A1 | 3/2011 | Fountain et al. | |
| 2011/0120508 | A1 | 5/2011 | Yoon et al. | |
| 2011/0146714 | A1 | 6/2011 | Fountain | |
| 2011/0146731 | A1 | 6/2011 | Fountain | |
| 2012/0118330 | A1 | 5/2012 | Tuller et al. | |
| 2012/0118336 | A1 | 5/2012 | Welch | |
| 2012/0138096 | A1 | 6/2012 | Tuller et al. | |
| 2012/0138106 | A1 | 6/2012 | Fountain et al. | |
| 2012/0138107 | A1 | 6/2012 | Fountain et al. | |
| 2012/0291805 | A1 | 11/2012 | Tuller et al. | |
| 2012/0291822 | A1 | 11/2012 | Tuller et al. | |
| 2012/0318295 | A1 | 12/2012 | Delgado et al. | |
| 2012/0318296 | A1 | 12/2012 | Fountain et al. | |
| 2012/0318308 | A1 | 12/2012 | Fountain et al. | |
| 2012/0318309 | A1 | 12/2012 | Tuller et al. | |

FOREIGN PATENT DOCUMENTS

| | | | | |
|---|---|---|---|---|
| CN | 2761660 | Y | 3/2006 | |
| CN | 1966129 | A | 5/2007 | |
| CN | 2907830 | Y | 6/2007 | |
| CN | 101406379 | A | 4/2009 | |
| CN | 201276653 | Y | 7/2009 | |
| CN | 201361486 | Y | 12/2009 | |
| CN | 101654855 | A | 2/2010 | |
| CN | 201410325 | Y | 2/2010 | |
| CN | 201473770 | Y | 5/2010 | |
| DE | 1134489 | | 8/1962 | |
| DE | 1428358 | A1 | 11/1968 | |
| DE | 1453070 | | 3/1969 | |
| DE | 7105474 | | 8/1971 | |
| DE | 2825242 | A1 | 1/1979 | |
| DE | 3337369 | A1 | 4/1985 | |
| DE | 3723721 | A1 | 5/1988 | |
| DE | 3842997 | A1 | 7/1990 | |
| DE | 4011834 | | 10/1991 | |
| DE | 4016915 | A1 | 11/1991 | |
| DE | 4131914 | A1 * | 4/1993 | A47L 15/42 |
| DE | 4131914 | A1 | 4/1993 | |
| DE | 9415486 | U1 | 11/1994 | |
| DE | 9416710 | U | 12/1994 | |
| DE | 4418523 | A1 | 11/1995 | |
| DE | 4433842 | C1 | 3/1996 | |
| DE | 69111365 | T2 | 3/1996 | |
| DE | 4413432 | C1 | 8/1996 | |
| DE | 19546965 | A1 | 6/1997 | |
| DE | 69403957 | T2 | 1/1998 | |
| DE | 19652235 | A1 | 6/1998 | |
| DE | 10000772 | A1 | 7/2000 | |
| DE | 69605965 | T2 | 8/2000 | |
| DE | 19951838 | A1 | 5/2001 | |
| DE | 10065571 | A1 | 7/2002 | |
| DE | 10106514 | A1 | 8/2002 | |
| DE | 60206490 | T2 | 5/2006 | |
| DE | 60302143 | | 8/2006 | |
| DE | 102005023428 | A1 | 11/2006 | |
| DE | 102005038433 | A1 | 2/2007 | |
| DE | 102007007133 | A1 | 8/2008 | |
| DE | 102007060195 | A1 | 6/2009 | |
| DE | 102009027910 | A1 | 1/2011 | |
| DE | 102009028278 | A1 | 2/2011 | |
| DE | 102010061215 | | 6/2011 | |
| DE | 102011052846 | A1 | 5/2012 | |
| EP | 0068974 | A1 | 1/1983 | |
| EP | 0178202 | A1 | 4/1986 | |
| EP | 0208900 | A2 | 1/1987 | |
| EP | 0370552 | | 5/1990 | |
| EP | 0374616 | A1 | 6/1990 | |
| EP | 0383028 | A2 | 8/1990 | |
| EP | 0405627 | A1 | 1/1991 | |
| EP | 437189 | A1 | 7/1991 | |
| EP | 0454640 | A1 | 10/1991 | |
| EP | 0521815 | A1 | 1/1993 | |
| EP | 0585905 | A2 | 3/1994 | |
| EP | 0597907 | B1 | 12/1995 | |
| EP | 0702928 | A1 | 3/1996 | |
| EP | 0725182 | A1 | 8/1996 | |
| EP | 0748607 | A2 | 12/1996 | |
| EP | 0752231 | A1 | 1/1997 | |
| EP | 752231 | A1 | 1/1997 | |
| EP | 0854311 | A2 | 7/1998 | |
| EP | 0855165 | A2 | 7/1998 | |
| EP | 0898928 | A1 | 3/1999 | |
| EP | 1029965 | A1 | 8/2000 | |
| EP | 1224902 | A2 | 7/2002 | |
| EP | 1256308 | A2 | 11/2002 | |
| EP | 1264570 | A1 | 12/2002 | |
| EP | 1319360 | A1 | 6/2003 | |
| EP | 1342827 | A1 | 9/2003 | |
| EP | 1346680 | A2 | 9/2003 | |
| EP | 1386575 | A1 | 2/2004 | |
| EP | 1415587 | A1 | 5/2004 | |
| EP | 1498065 | A1 | 1/2005 | |
| EP | 1743871 | A1 | 1/2007 | |
| EP | 1862104 | A1 | 12/2007 | |
| EP | 1882436 | A1 | 1/2008 | |
| EP | 1583455 | B1 | 8/2008 | |
| EP | 1980193 | A1 | 10/2008 | |
| EP | 2127587 | A1 | 2/2009 | |
| EP | 2075366 | A1 | 7/2009 | |
| EP | 2138087 | A1 | 12/2009 | |

(56) References Cited

FOREIGN PATENT DOCUMENTS

| | | | |
|---|---|---|---|
| EP | 2351507 | | 12/2010 |
| EP | 1703834 | B1 | 2/2011 |
| EP | 2332457 | A1 | 6/2011 |
| EP | 2335547 | | 6/2011 |
| EP | 2338400 | | 6/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 1047948 | | 11/1966 |
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | A | 9/1986 |
| JP | 1005521 | A | 1/1989 |
| JP | 1080331 | A | 3/1989 |
| JP | 5245094 | A | 9/1993 |
| JP | 07178030 | | 7/1995 |
| JP | 10109007 | A | 4/1998 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| KR | 2001-0077128 | | 8/2001 |
| KR | 2009-0006659 | | 1/2009 |
| WO | 2005058124 | A1 | 6/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |

OTHER PUBLICATIONS

German Search Report for DE102010061347, Jan. 23, 2013.
German Search Report for DE102010061215, Feb. 7, 2013.
European Search Report for EP11188106, Mar. 29, 2012.
German Search Report for DE102010061343, Jul. 7, 2011.
German Search Report for DE102010061342, Aug. 19, 2011.
German Search Report for DE102010061346, Sep. 30, 2011.
European Search Report for Corresponding EP 12191467.5, Dec. 5, 2012.

* cited by examiner

ROTATING DRUM FILTER FOR A DISHWASHING MACHINE

TECHNICAL FIELD

The present disclosure relates generally to a dishwashing machine and more particularly to a filter for a dishwashing machine.

BACKGROUND

A dishwashing machine is a domestic appliance into which dishes and other cooking and eating wares (e.g., plates, bowls, glasses, flatware, pots, pans, bowls, etcetera) are placed to be washed. A dishwashing machine includes various filters to separate soil particles from wash fluid.

SUMMARY

According to one aspect, a dishwashing machine includes a spray arm, a sump positioned below the spray arm for collecting fluid and soil particles, and a housing in fluid communication with the sump and the spray arm. The housing has an inner chamber, and a filter is positioned in the inner chamber. The filter is operable to rotate about a longitudinal axis and has an outer surface. A flow diverter is positioned in the inner chamber, and the flow diverter has a tip spaced apart from the outer surface of the porous sheet so as to define a gap. During rotation of the porous sheet, the angular velocity of fluid advanced through the gap is increased relative to the angular velocity of the fluid prior to entering the gap.

In some embodiments, the dishwashing machine may further include a wash pump having an impeller coupled to the porous sheet. The impeller may be operable to rotate about the axis. The filter may include a cylindrical porous sheet, which may enclose a hollow interior, and the rotation of the impeller may advance fluid through the porous sheet into the hollow interior.

In some embodiments, the wash pump may have an inlet port positioned within the hollow interior and an outlet port fluidly coupled to the spray arm. In some embodiments, the dishwashing machine may further include a second flow diverter positioned within the hollow interior. The second flow diverter may have an outer surface spaced apart from an inner surface of the porous sheet.

In some embodiments, pores of the porous sheet are sized such that soil particles accumulate on the outer surface of the porous sheet as fluid advances through the porous sheet into the hollow interior. Additionally, in some embodiments, soil particles accumulated on the outer surface of the porous sheet may be removed by fluid passing through the gap during rotation of the porous sheet. In some embodiments, the porous sheet is a sheet of chemically etched metal. In some embodiments, the dishwashing machine may further include a drain pump coupled to the housing. The drain pump may be operable to remove fluid from the inner chamber.

In some embodiments, the impeller and the sheet may be rotated about the axis at 3200 rpm. In some embodiments, the gap may be sized such that the angular velocity of the fluid is at least sixteen percent greater than the angular velocity of fluid that bypasses the gap.

In some embodiments, the housing may have an inlet fluidly coupled to the sump, and the inlet may have a porous screen positioned therein such that fluid advancing from the sump passes through the porous screen.

In some embodiments, the housing may have an inner surface facing the inner chamber, and a number of ribs may extend away from the inner surface into the inner chamber.

According to another aspect, the dishwashing machine includes a washing chamber having a bottom surface, a sump positioned in the bottom surface of the washing chamber, a housing fluidly coupled to the sump having an inner chamber defined therein, and a filter positioned in the inner chamber. The filter is operable to rotate about an imaginary axis, and a filter sheet extends from a first end of the filter to a second end of the filter. The filter sheet defines a hollow interior. The dishwashing machine also includes a first flow diverter positioned in the inner chamber at a location between the housing and the filter, and a second flow diverter positioned opposite the first flow diverter at a location within the hollow interior of the filter. The second flow diverter is spaced apart from the first flow diverter so as to create a gap. The angular velocity of fluid advanced through the gap is increased relative to fluid bypassing the gap during rotation of the filter.

In some embodiments, the first flow diverter may extend from the first end of the drum to the second end of the drum. In some embodiments, the dishwashing machine may also include a beam positioned in the hollow interior. The second flow diverter may be coupled to a portion of the beam.

In some embodiments, the dishwashing machine may further include a bearing secured to the housing and rotatably coupled to the second end of the drum. In some embodiments, dishwashing machine may further include a wash pump in fluid communication with the inner chamber. The wash pump may be operable to draw fluid through the filter sheet into the hollow interior. The filter sheet may have a plurality of pores extending from an outer surface to an inner surface, and the pores of the filter sheet may be sized such that fluid advances therethrough to the hollow interior and soil particles accumulate on the outer surface of the filter sheet.

In some embodiments, soil particles accumulated on the outer surface of the filter sheet may be removed as the outer surface of the filter sheet passes through the gap between the first flow diverter and the second flow diverter.

According to another aspect, a recirculation pump assembly for a dishwasher is disclosed. The assembly includes a housing having an inlet port configured to be fluidly coupled to a sump of a dishwasher and an outlet port configured to be fluidly coupled to a spray arm of the dishwasher, and an impeller positioned at a first end of the housing between the inlet port and the outlet port. The impeller is operable to rotate about an axis such that fluid is advanced from the inlet port to the outlet port. The assembly also includes a rotary filter coupled at a first end to the impeller and at a second end to the bearing. The assembly also includes a flow diverter positioned within the inner chamber at a location between the housing and the rotary filter. The flow diverter is spaced apart from the rotary filter so as to create a gap. The angular velocity of fluid advanced through the gap is increased relative to fluid bypassing the gap during rotation of the rotary filter.

BRIEF DESCRIPTION OF THE DRAWINGS

The detailed description particularly refers to the following figures, in which.

DETAILED DESCRIPTION OF THE DRAWINGS

Figure 1:
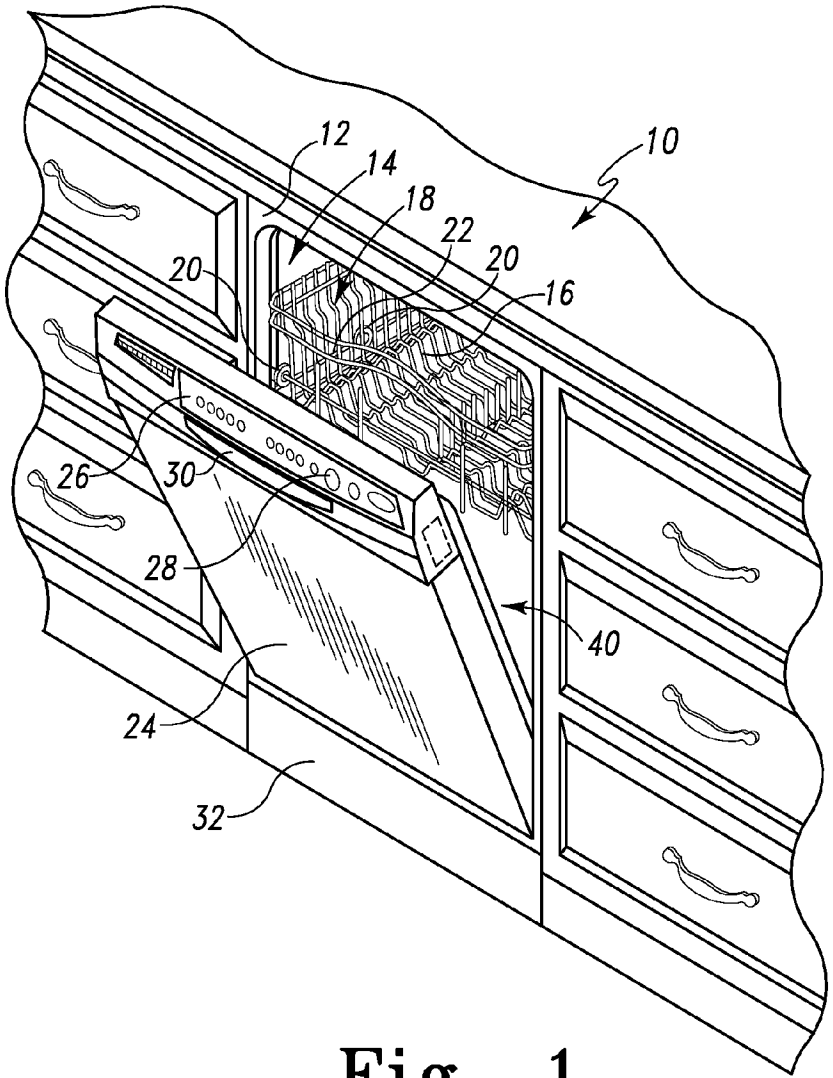
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwashing machine 10 (hereinafter dishwasher 10) is shown. The dishwasher 10 has a tub 12 that defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from and retract into the tub 12, which facilitates the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, which are used by a controller (not shown) to control the operation of the dishwasher 10. A handle 30 is also included in the control panel 26. The user may use the handle 30 to unlatch and open the door 24 to access the tub 12.

Figure 2:
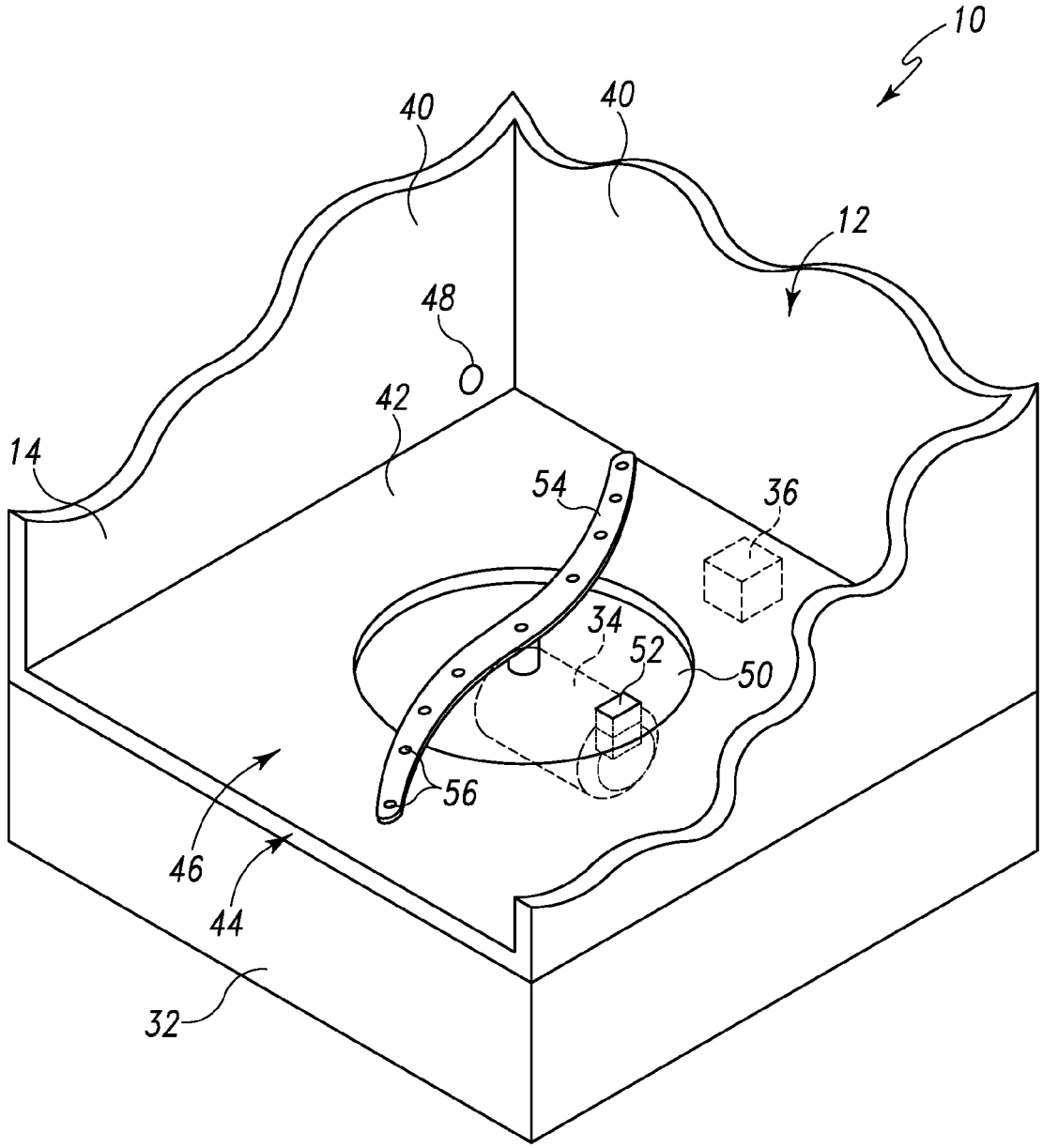
FIG. 2 is a fragmentary perspective view of the tub of the dishwashing machine of FIG. 1.

A machine compartment 32 is located below the tub 12. The machine compartment 32 is sealed from the tub 12. In other words, unlike the tub 12, which is filled with fluid and exposed to spray during the wash cycle, the machine compartment 32 does not fill with fluid and is not exposed to spray during the operation of the dishwasher 10. Referring now to FIG. 2, the machine compartment 32 houses a recirculation pump assembly 34 and the drain pump 36, as well as the dishwasher's other motor(s) and valve(s), along with the associated wiring and plumbing.

Referring now to FIG. 2, the tub 12 of the dishwasher 10 is shown in greater detail. The tub 12 includes a number of side walls 40 extending upwardly from a bottom wall 42 to define the washing chamber 14. The open front side 44 of the tub 12 defines an access opening 46 of the dishwasher 10. The access opening 46 provides the user with access to the dish racks 16 positioned in the washing chamber 14 when the door 24 is open. When closed, the door 24 seals the access opening 46, which prevents the user from accessing the dish racks 16. The door 24 also prevents fluid from escaping through the access opening 46 of the dishwasher 10 during a wash cycle.

The bottom wall 42 of the tub 12 has a sump 50 positioned therein. At the start of a wash cycle, fluid enters the tub 12 through a hole 48 defined in the side wall 40. The sloped configuration of the bottom wall 42 directs fluid into the sump 50. The recirculation pump assembly 34 removes such water and/or wash chemistry from the sump 50 through a hole 52 defined the bottom of the sump 50 after the sump 50 is partially filled with fluid.

The recirculation pump assembly 34 is fluidly coupled to a rotating spray arm 54 that sprays water and/or wash chemistry onto the dish racks 16 (and hence any wares positioned thereon). Additional rotating spray arms (not shown) are positioned above the spray arm 54. It should also be appreciated that the dishwashing machine 10 may include other spray arms positioned at various locations in the tub 12. As shown in FIG. 2, the spray arm 54 has a number of nozzles 56. Fluid passes from the recirculation pump assembly 34 into the spray arm 54 and then exits the spray arm 54 through the nozzles 56. In the illustrative embodiment described herein, the nozzles 56 are embodied simply as holes formed in the spray arm 54. However, it is within the scope of the disclosure for the nozzles 56 to include inserts such as tips or other similar structures that are placed into the holes formed in the spray arm 54. Such inserts may be useful in configuring the spray direction or spray pattern of the fluid expelled from the spray arm 54.

After wash fluid contacts the dish racks 16 and any wares positioned in the washing chamber 14, a mixture of fluid and soil falls onto the bottom wall 42 and collects in the sump 50. The recirculation pump assembly 34 draws the mixture out of the sump 50 through the hole 52. As will be discussed in detail below, fluid is filtered in the recirculation pump assembly 34 and re-circulated onto the dish racks 16. At the conclusion of the wash cycle, the drain pump 36 removes both wash fluid and soil particles from the sump 50 and the tub 12.

Figure 3:
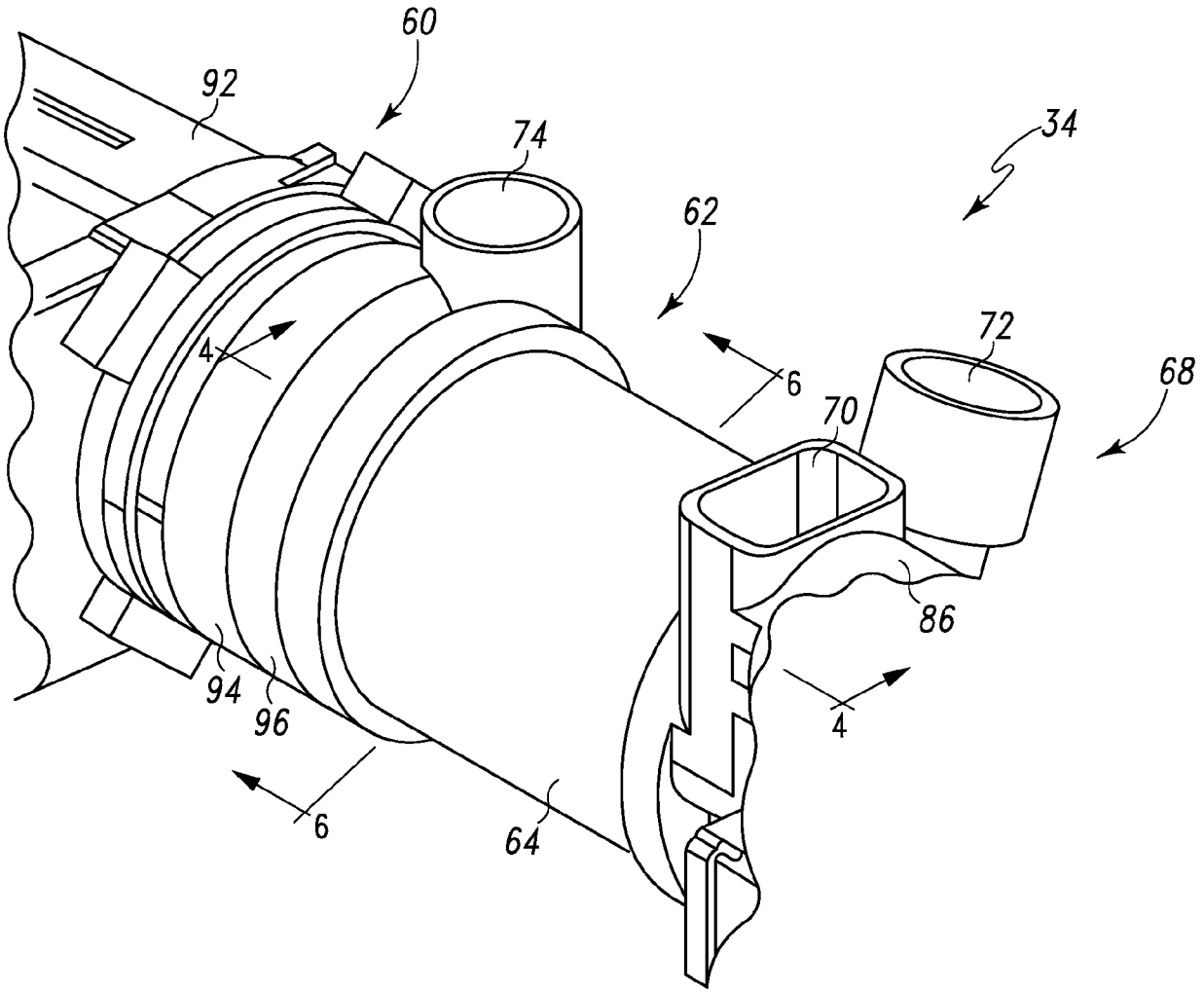
FIG. 3 is a perspective view of an embodiment of a pump and filter assembly for the dishwashing machine of FIG. 1.

Referring now to FIG. 3, the recirculation pump assembly 34 is shown removed from the dishwasher 10. The recirculation pump assembly 34 includes a wash pump 60 that is secured to a housing 62. The housing 62 includes cylindrical filter casing 64 positioned between a manifold 68 and the wash pump 60. The manifold 68 has an inlet port 70, which is fluidly coupled to the hole 52 defined in the sump 50, and an outlet port 72, which is fluidly coupled to the drain pump 36. Another outlet port 74 extends upwardly from the wash pump 60 and is fluidly coupled to the rotating spray arm 54. While recirculation pump assembly 34 is included in the dishwasher 10, it will be appreciated that in other embodiments the recirculation pump assembly 34 may be a device separate from the dishwasher 10. For example, the recirculation pump assembly 34 might be positioned in a cabinet adjacent to the dishwasher 10. In such embodiments, a number of fluid hoses may be used to connect the recirculation pump assembly 34 to the dishwasher 10.

Figure 4:
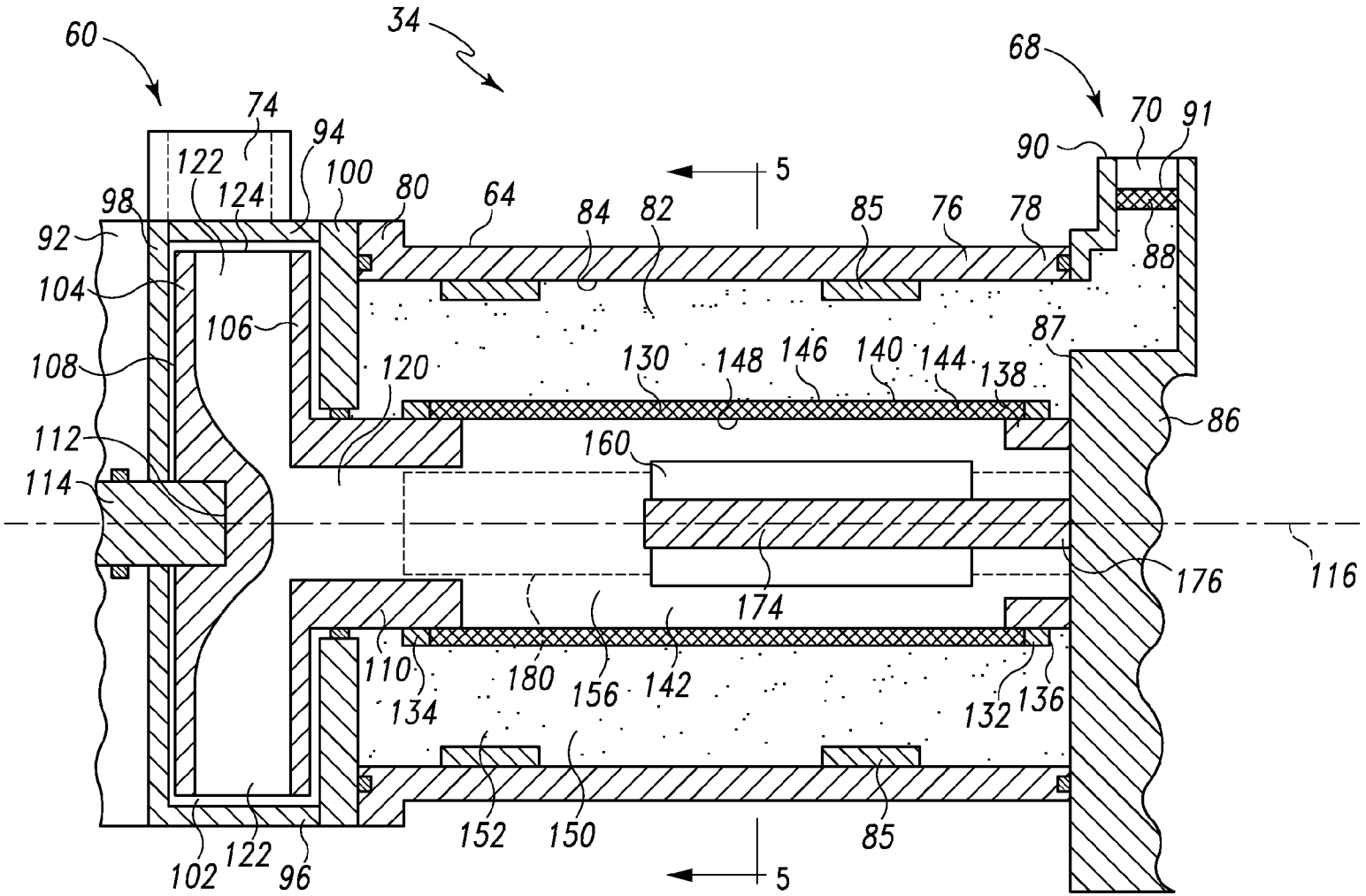
FIG. 4 is a cross-sectional elevation view of the pump and filter assembly of FIG. 3 taken along the line 4-4 shown in FIG. 3.

Referring now to FIG. 4, a cross-sectional view of the recirculation pump assembly 34 is shown. The filter casing 64 is a hollow cylinder having a side wall 76 that extends from an end 78 secured to the manifold 68 to an opposite end 80 secured to the wash pump 60. The side wall 76 defines a filter chamber 82 that extends the length of the filter casing 64.

The side wall 76 has an inner surface 84 facing the filter chamber 82. A number of rectangular ribs 85 extend from the inner surface 84 into the filter chamber 82. The ribs 85 are configured to create drag to counteract the movement of fluid within the filter chamber 82. It should be appreciated that in other embodiments each of the ribs 85 may take the form of a wedge, cylinder, pyramid, or other shape configured to create drag to counteract the movement of fluid within the filter chamber 82.

The manifold 68 has a main body 86 that is secured to the end 78 of the filter casing 64. The inlet port 70 extends upwardly from the main body 86 and is configured to be coupled to a fluid hose (not shown) extending from the hole 52 defined in the sump 50. The inlet port 70 opens through a sidewall 87 of the main body 86 into the filter chamber 82 of the filter casing 64. As such, during the wash cycle, a mixture of fluid and soil particles advances from the sump 50 into the filter chamber 82 and fills the filter chamber 82. As shown in FIG. 4, the inlet port 70 has a filter screen 88 positioned at an upper end 90. The filter screen 88 has a plurality of holes 91 extending therethrough. Each of the holes 91 is sized such that large soil particles are prevented from advancing into the filter chamber 82.

A passageway (not shown) places the outlet port 72 of the manifold 68 in fluid communication with the filter chamber 82. When the drain pump 36 is energized, fluid and soil particles from the sump 50 pass downwardly through the inlet port 70 into the filter chamber 82. Fluid then advances from the filter chamber 82 through the passageway and out the outlet port 72.

The wash pump 60 is secured at the opposite end 80 of the filter casing 64. The wash pump 60 includes a motor 92 (see FIG. 3) secured to a cylindrical pump housing 94. The pump housing 94 includes a side wall 96 extending from a base wall 98 to an end wall 100. The base wall 98 is secured to the motor 92 while the end wall 100 is secured to the end 80 of the filter casing 64. The walls 96, 98, 100 define an impeller chamber 102 that fills with fluid during the wash cycle. As shown in FIG. 4, the outlet port 74 is coupled to the side wall 96 of the pump housing 94 and opens into the chamber 102. The outlet port 74 is configured to receive a fluid hose (not shown) such that the outlet port 74 may be fluidly coupled to the spray arm 54.

The wash pump 60 also includes an impeller 104. The impeller 104 has a shell 106 that extends from a back end 108 to a front end 110. The back end 108 of the shell 106 is positioned in the chamber 102 and has a bore 112 formed therein. A drive shaft 114, which is rotatably coupled to the motor 92, is received in the bore 112. The motor 92 acts on the drive shaft 114 to rotate the impeller 104 about an imaginary axis 116 in the direction indicated by arrow 118 (see FIG. 5). The motor 92 is connected to a power supply (not shown), which provides the electric current necessary for the motor 92 to spin the drive shaft 114 and rotate the impeller 104. In the illustrative embodiment, the motor 92 is configured to rotate the impeller 104 about the axis 116 at 3200 rpm.

The front end 110 of the impeller shell 106 is positioned in the filter chamber 82 of the filter casing 64 and has an inlet opening 120 formed in the center thereof. The shell 106 has a number of vanes 122 that extend away from the inlet opening 120 to an outer edge 124 of the shell 106. The rotation of the impeller 104 about the axis 116 draws fluid from the filter chamber 82 of the filter casing 64 into the inlet opening 120. The fluid is then forced by the rotation of the impeller 104 outward along the vanes 122. Fluid exiting the impeller 104 is advanced out of the chamber 102 through the outlet port 74 to the spray arm 54.

As shown in FIG. 4, the front end 110 of the impeller shell 106 is coupled to a rotary filter 130 positioned in the filter chamber 82 of the filter casing 64. The filter 130 has a cylindrical filter drum 132 extending from an end 134 secured to the impeller shell 106 to an end 136 rotatably coupled to a bearing 138, which is secured the main body 86 of the manifold 68. As such, the filter 130 is operable to rotate about the axis 116 with the impeller 104.

A filter sheet 140 extends from one end 134 to the other end 136 of the filter drum 132 and encloses a hollow interior 142. The sheet 140 includes a number of holes 144, and each hole 144 extends from an outer surface 146 of the sheet 140 to an inner surface 148. In the illustrative embodiment, the sheet 140 is a sheet of chemically etched metal. Each hole 144 is sized to allow for the passage of wash fluid into the hollow interior 142 and prevent the passage of soil particles.

As such, the filter sheet 140 divides the filter chamber 82 into two parts. As wash fluid and removed soil particles enter the filter chamber 82 through the inlet port 70, a mixture 150 of fluid and soil particles is collected in the filter chamber 82 in a region 152 external to the filter sheet 140. Because the holes 144 permit fluid to pass into the hollow interior 142, a volume of filtered fluid 156 is formed in the hollow interior 142.

Figure 5:
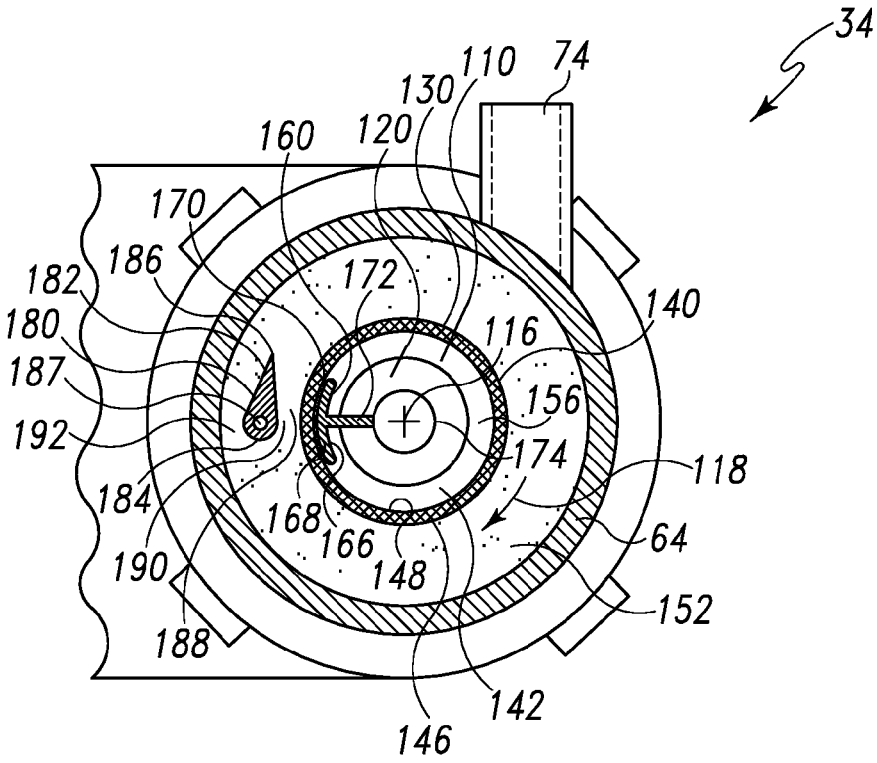
FIG. 5 is a cross-sectional elevation view of the pump and filter assembly of FIG. 3 taken along the line 5-5 shown in FIG. 4 showing the rotary filter with two flow diverters.

Referring now to FIGS. 4 and 5, a flow diverter 160 is positioned in the hollow interior 142 of the filter 130. The diverter 160 has a body 166 that is positioned adjacent to the inner surface 148 of the sheet 140. The body 166 has an outer surface 168 that defines a circular arc 170 having a radius smaller than the radius of the sheet 140. A number of arms 172 extend away from the body 166 and secure the diverter 160 to a beam 174 positioned in the center of the filter 130. As best seen in FIG. 4, the beam 174 is coupled at an end 176 to the side wall 87 of the manifold 68. In this way, the beam 174 secures the body 166 to the housing 62.

Another flow diverter 180 is positioned between the outer surface 146 of the sheet 140 and the inner surface 84 of the housing 62. The diverter 180 has a fin-shaped body 182 that extends from a leading edge 184 to a trailing end 186. As shown in FIG. 4, the body 182 extends along the length of the filter drum 132 from one end 134 to the other end 136. It will be appreciated that in other embodiments the diverter 180 may take other forms, such as, for example, having an inner surface that defines a circular arc having a radius larger than the radius of the sheet 140. As shown in FIG. 5, the body 182 is secured to a beam 184. The beam 187 extends from the side wall 87 of the manifold 68. In this way, the beam 187 secures the body 182 to the housing 62.

As shown in FIG. 5, the diverter 180 is positioned opposite the diverter 160 on the same side of the filter chamber 82. The diverter 160 is spaced apart from the diverter 180 so as to create a gap 188 therebetween. The sheet 140 is positioned within the gap 188.

In operation, wash fluid, such as water and/or wash chemistry (i.e., water and/or detergents, enzymes, surfactants, and other cleaning or conditioning chemistry), enters the tub 12 through the hole 48 defined in the side wall 40 and flows into the sump 50 and down the hole 52 defined therein. As the filter chamber 82 fills, wash fluid passes through the holes 144 extending through the filter sheet 140 into the hollow interior 142. After the filter chamber 82 is completely filled and the sump 50 is partially filled with wash fluid, the dishwasher 10 activates the motor 92.

Activation of the motor 92 causes the impeller 104 and the filter 130 to rotate. The rotation of the impeller 104 draws wash fluid from the filter chamber 82 through the filter sheet 140 and into the inlet opening 120 of the impeller shell 106. Fluid then advances outward along the vanes 122 of the impeller shell 106 and out of the chamber 102 through the outlet port 74 to the spray arm 54. When wash fluid is delivered to the spray arm 54, it is expelled from the spray arm 54 onto any dishes or other wares positioned in the washing chamber 14. Wash fluid removes soil particles located on the dishwares, and the mixture of wash fluid and soil particles falls onto the bottom wall 42 of the tub 12. The sloped configuration of the bottom wall 42 directs that mixture into the sump 50 and down the hole 52 defined in the sump 50.

While fluid is permitted to pass through the sheet 140, the size of the holes 144 prevents the soil particles of the mixture 152 from moving into the hollow interior 142. As a result, those soil particles accumulate on the outer surface 146 of the sheet 140 and cover the holes 144, thereby preventing fluid from passing into the hollow interior 142.

The rotation of the filter 130 about the axis 116 causes the mixture 150 of fluid and soil particles within the filter chamber 82 to rotate about the axis 116 in the direction indicated by the arrow 118. Centrifugal force urges the soil particles toward the side wall 76 as the mixture 150 rotates about the axis 116. The diverters 160, 180 divide the mixture 150 into a first portion 190, which advances through the gap 188, and a second portion 192, which bypasses the gap 188. As the portion 190 advances through the gap 188, the angular velocity of the portion 190 increases relative to its previous velocity as well as relative to the second portion 192. The increase in angular velocity results in a low pressure region between the diverters 160, 180. In that low pressure region, accumulated soil particles are lifted from the sheet 140, thereby cleaning the sheet 140 and permitting the passage of fluid through the holes 144 into the hollow interior 142. Additionally, the acceleration accompanying the increase in angular velocity as the portion 190 enters the gap 188 provides additional force to lift the accumulated soil particles from the sheet 140.

Figure 6:
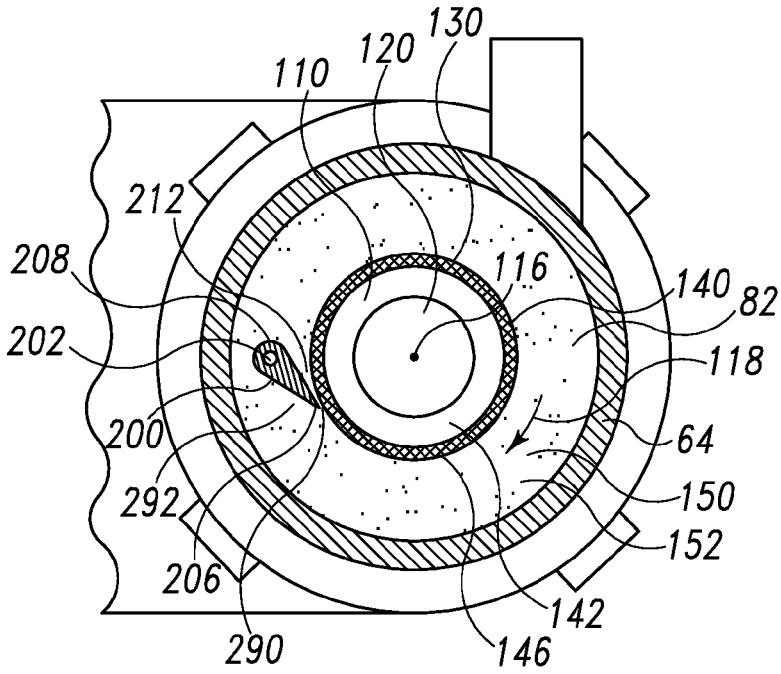
FIG. 6 is a cross-sectional elevation view of the pump and filter assembly of FIG. 3 taken along the line 6-6 shown in FIG. 3 showing another embodiment of the rotary filter with a single flow diverter.

Referring now to FIG. 6, a cross-section of another embodiment of the rotary filter 130 with a single flow diverter 200. The diverter 200, like the diverter 180 of the embodiment of FIGS. 1-5, is positioned within the filter chamber 82 external of the hollow interior 142. The diverter 200 is secured to the side wall 87 of the manifold 68 via a beam 202. The diverter 200 has a fin-shaped body 204 that extends from a tip 206 to a trailing end 208. The tip 206 has a leading edge 210 that is positioned proximate to the outer surface 146 of the sheet 140, and the tip 206 and the outer surface 146 of the sheet 140 define a gap 212 therebetween.

In operation, the rotation of the filter 130 about the axis 116 causes the mixture 150 of fluid and soil particles to rotate about the axis 116 in the direction indicated by the arrow 118. The diverter 200 divides the mixture 150 into a first portion 290, which passes through the gap 212 defined between the diverter 200 and the sheet 140, and a second portion 292, which bypasses the gap 212. As the first portion 290 passes through the gap 212, the angular velocity of the first portion 290 of the mixture 150 increases relative to the second portion 292. The increase in angular velocity results in low pressure in the gap 212 between the diverter 200 and the outer surface 146 of the sheet 140. In that low pressure region, accumulated soil particles are lifted from the sheet 140 by the first portion 290 of the fluid, thereby cleaning the sheet 140 and permitting the passage of fluid through the holes 144 into the hollow interior 142. In some embodiments, the gap 212 is sized such that the angular velocity of the first portion 290 is at least sixteen percent greater than the angular velocity of the second portion 292 of the fluid.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A dishwashing machine comprising:

a spray arm, a sump positioned below the spray arm for collecting fluid and soil particles, a housing in fluid communication with the sump and the spray arm, the housing having an inner chamber, a filter enclosing a hollow interior and positioned in the inner chamber and fluidly dividing the inner chamber into a first part that contains filtered soil particles and a second part that excludes filtered soil particles and operable to rotate about a longitudinal axis, the filter having an outer surface, a wash pump including an impeller operably coupled to the filter, the impeller being operable to rotate about the axis, and a flow diverter positioned in the inner chamber, the flow diverter having a tip spaced apart from the outer surface of the filter so as to define a gap, wherein the rotation of the impeller advances fluid through the filter into the hollow interior and during rotation of the filter, an angular velocity of fluid advanced through the gap is increased relative to the angular velocity of the fluid prior to entering the gap.

2. The dishwashing machine of claim 1, wherein the wash pump has an inlet port positioned within the hollow interior and an outlet port fluidly coupled to the spray arm.

3. The dishwashing machine of claim 1, further comprising a second flow diverter positioned within the hollow interior, the second flow diverter having an outer surface spaced apart from an inner surface of the filter.

4. The dishwashing machine of claim 1, wherein pores of the filter are sized such that soil particles accumulate on the outer surface of the filter as fluid advances through the filter into the hollow interior.

5. The dishwashing machine of claim 4, wherein soil particles accumulated on the outer surface of the filter are removed by fluid passing through the gap during rotation of the filter.

6. The dishwashing machine of claim 1, wherein the filter comprises a porous sheet.

7. The dishwashing machine of claim 6, wherein the porous sheet is a sheet of chemically etched metal.

8. The dishwashing machine of claim 1, further comprising a drain pump coupled to the housing, wherein the drain pump is operable to remove fluid from the inner chamber.

9. The dishwashing machine of claim 1, wherein the impeller and the filter are rotated about the axis at 3200 rpm.

10. The dishwashing machine of claim 1, wherein the gap is sized such that the angular velocity of the fluid is at least sixteen percent greater than the angular velocity of the fluid prior to entering the gap.

11. The dishwashing machine of claim 1, wherein:

the housing has an inlet fluidly coupled to the sump, and the inlet has a porous screen positioned therein such that fluid advancing from the sump passes through the porous screen.

12. The dishwashing machine of claim 1, wherein:

(i) the housing has an inner surface facing the inner chamber, and (ii) a number of ribs extend away from the inner surface into the inner chamber.

13. A dishwashing machine comprising:

a washing chamber having a bottom surface, a sump positioned in the bottom surface of the washing chamber, a housing fluidly coupled to the sump, the housing having an inner chamber defined therein, a filter positioned in the inner chamber, the filter being operable to rotate about an imaginary axis, a filter sheet extending from a first end of the filter to a second end of the filter, the filter sheet having an inner surface and an outer surface, a first flow diverter positioned in the inner chamber at a location between the housing and at least one of the inner surface and the outer surface of the filter, and a second flow diverter positioned opposite the first flow diverter at a location adjacent the other of the inner surface and the outer surface, the second flow diverter is spaced apart from the first flow diverter so as to create a gap, wherein an angular velocity of fluid advanced through the gap is increased relative to fluid bypassing the gap during rotation of the filter.

14. The dishwashing machine of claim 13, wherein the first flow diverter extends from the first end of the filter to the second end of the filter.

15. The dishwashing machine of claim 13, further comprising a bearing secured to the housing and rotatably coupled to the second end of the filter.

16. The dishwashing machine of claim 13, wherein the filter sheet defines a hollow interior.

17. The dishwashing machine of claim 16, further comprising a beam positioned in the hollow interior, wherein the second flow diverter is coupled to a portion of the beam.

18. The dishwashing machine of claim 16, further comprising a wash pump in fluid communication with the inner chamber, the wash pump being operable to draw fluid through the filter sheet into the hollow interior.

19. The dishwashing machine of claim 18, wherein:

the filter sheet has a plurality of pores extending from the outer surface to the inner surface, and the pores of the filter sheet are sized such that fluid advances therethrough and soil particles accumulate on the outer surface of the filter sheet.

20. The dishwashing machine of claim 19, wherein soil particles accumulated on the outer surface of the filter sheet are removed as the outer surface of the filter sheet passes through the gap between the first flow diverter and the second flow diverter.

21. A recirculation pump assembly for a dishwasher, comprising:

a housing having an inner chamber defined therein and having an inlet port configured to be fluidly coupled to a sump of a dishwasher and an outlet port configured to be fluidly coupled to a spray arm of the dishwasher, an impeller positioned at a first end of the housing between the inlet port and the outlet port, the impeller being operable to rotate about an axis such that fluid is advanced from the inlet port to the outlet port, a rotary filter coupled at a first end to the impeller and at a second end to a bearing, and a flow diverter positioned within the inner chamber at a location between the housing and the rotary filter, the flow diverter being spaced apart from the rotary filter so as to create a gap, wherein an angular velocity of fluid advanced through the gap is increased relative to fluid bypassing the gap during rotation of the rotary filter.

22. The recirculation pump assembly of claim 21, wherein the rotary filter defines a hollow interior.

* * * * *